US006736856B1

(12) United States Patent
Takahashi et al.

(10) Patent No.: US 6,736,856 B1
(45) Date of Patent: May 18, 2004

(54) CROSSLINKED ACRYLIC MOISTURE ABSORBING FIBERS AND PRODUCTION METHODS THEREOF

(75) Inventors: Hayashi Takahashi, Shizuoka (JP); Hideo Matsumoto, Shizuoka (JP)

(73) Assignee: Toho Tenax Co., Ltd., Tokyo (JP)

( * ) Notice: Subject to any disclaimer, the term of this patent is extended or adjusted under 35 U.S.C. 154(b) by 0 days.

(21) Appl. No.: 09/703,987

(22) PCT Filed: Oct. 28, 1999

(86) PCT No.: PCT/JP99/05974

§ 371 (c)(1),
(2), (4) Date: Nov. 1, 2000

(87) PCT Pub. No.: WO00/55417

PCT Pub. Date: Sep. 21, 2000

(30) Foreign Application Priority Data

Mar. 18, 1999 (JP) ..... 11-074332

(51) Int. Cl.[7] ..... D06M 11/63; D06M 13/338

(52) U.S. Cl. ..... 8/115.51; 8/115.68; 8/115.69; 525/329.1; 525/329.2; 525/329.3; 525/367; 525/376

(58) Field of Search ..... 8/115.1, 115.68, 8/115.69, 115.51; 525/329.1, 329.2, 329.3, 367, 376

(56) References Cited

U.S. PATENT DOCUMENTS 5,292,822 A * 3/1994 Tanaka et al. ..... 525/329.1
5,783,304 A * 7/1998 Nakajima et al. ..... 428/364
5,853,879 A * 12/1998 Takamiya et al. ..... 428/364
6,143,390 A * 11/2000 Takamiya et al. ..... 428/90
6,429,265 B2 * 8/2002 Nishida ..... 525/329.5

* cited by examiner

*Primary Examiner*—D. R. Wilson
(74) *Attorney, Agent, or Firm*—Jordan and Hamburg LLP

(57) ABSTRACT

The invention provides a production method capable of reducing the amount of the chemical liquid (hydrazine and sodium carbonate, etc.) for applying a crosslinking treatment and a hydrolytic treatment, capable of shortening the treatment time, and capable of obtaining crosslinked acrylic moisture absorbing fibers having a sufficient moisture absorbing-moisture releasing performance and provides crosslinked acrylic moisture absorbing fibers. In the case of producing the crosslinked acrylic moisture absorbing fibers by applying a crosslinking treatment and a hydrolytic treatment to acrylic fibers, acrylic fibers made of a copolymer containing from 1 to 5% by weight a comonomer having an acidic group as a comonomer component are used as the raw material fibers to be treated.

3 Claims, 1 Drawing Sheet

CROSSLINKED ACRYLIC MOISTURE ABSORBING FIBERS AND PRODUCTION METHODS THEREOF

TECHNICAL FIELD

The present invention relates to a crosslinked acrylic moisture absorbing fibers capable of reversibly and repeatedly carrying out moisture absorption and moisture releasing. More specifically, the invention relates to a method of efficiently obtaining crosslinked acrylic moisture absorbing fibers having a high quality by using acidic comonomer-containing acrylic fibers of at least 1% by weight as raw material acrylic fibers, and also to crosslinked acrylic moisture absorbing fibers obtained by the method.

BACKGROUND OF THE INVENTION

Acrylic fibers are one kind of synthetic fibers most widely used, and the moisture absorbing rate of usual commercially available acrylic fibers is from about 1 to 2%, which is lower than those of natural fibers such as cotton, sheep wool, etc. About such acrylic fibers, a fiber material which can be repeatedly carried out a moisture absorption and moisture releasing and also can be applied for the fields of clothes and nightdresses has been required.

For the purpose of imparting the moisture absorbing-moisture releasing property to acrylic fibers, it is proposed in Japanese Patent Laid-Open No. 91271/1990 or 132858/1993 that after applying a crosslinking treatment to acrylic fibers with hydrazine, the nitrile group remaining in the fibers are converted to a carboxyl group or the metal salt of a carboxyl group by hydrolyzing the nitrile group with an alkali metal hydroxide, whereby the crosslinked acrylic fibers imparted with the moisture absorbing-moisture releasing property.

In the above-described crosslinked acrylic moisture absorbing fibers of prior art, the saturated moisture absorbing rate and the degree of swelling by water under the standard condition of 20° and 65% RH show high values as from 25 to 50% and 150 to 300%, respectively.

Now, it is known that acrylic fibers are generally obtained by copolymerizing acrylonitrile as the main constituent and a neutral comonomer such as a vinyl monomer (such as vinyl acetate, a vinyl halide, a vinylidene halide, etc.), styrene, an acrylic acid ester, a methacrylic acid ester, (meth)acrylamide, etc.; an acidic comonomer such as sulfonic acid-containing comonomer (such as (meth) allylsulfonic acid, p-styrenesulfonic acid, etc., and the salts thereof), a carboxylic acid-containing comonomer (such as (meth)acrylic acid, itaconic acid, etc., and the salts thereof); or a basic comonomer such as vinylpyridine, methylvinylpyridine, etc., as other comonomer component.

Such a comonomer used for producing acrylic fibers is used for the purposes of improving the spinning property at the production of acrylic fibers and improving the characteristics of the products. In these comonomers, the acidic group-containing comonomer and the salts thereof, particularly, the sulfonic acid-containing comonomer and the salts thereof are generally used for improving the dyeing property, etc., of acrylic fibers, and usually the comonomer is copolymerized in a ratio of not more than 1% by weight.

Such an acidic group-containing comonomer has hitherto been used for improving the dyeing property of acrylic fibers even when the acrylic fibers contain more than 1% by weight the comonomer, the dyeing property is not further improved.

Thus, for general acrylic fibers for clothing, a copolymer containing at least 80% by weight an acrylonitrile component and not more than 1% by weight a dyeing property-improving comonomer (that is, an acidic group-containing comonomer) and a neutral comonomer is used.

Because in the crosslinking treatment by the above-described method of prior art, the object of the treatment is ordinary acrylic fibers widely used, the content of the acidic group-containing comonomer in the acrylic fibers is usually small as less than 1% by weight. For applying the crosslinking treatment to such acrylic fibers widely used, it was necessary to carry out the treatment using an aqueous solution of a hydrazine concentration of from 0.5 to 3 times to the fibers to be treated, that is, an aqueous solution of from 5 to 30% by weight hydrazine (bath ratio of 1:10), under a high-temperature condition of, for example, a temperature of 98° C. for a long time of from 3 to 10 hours.

As described above, in the case of producing above-described crosslinked acrylic fibers of prior art imparted with the moisture absorbing-moisture releasing property, there was a problem of requiring severe reaction conditions for the crosslinking treatment and the hydrolytic treatment, that is, the severe reaction conditions of the long treatment time under the high treatment temperature, and also there were problems that the using amount of the chemical liquid (hydrazine and alkali metal oxide, etc.) was large, an excessive amount of the chemical liquid for reaction had to be supplied to the fibers, and the cost of the fibers obtained became high.

Also, in the above-described crosslinked acrylic moisture absorbing fibers of prior art imparted with the moisture absorbing-moisture releasing-property, the problem that the form-retentivity after absorbing moisture (or after absorbing water) was inferior because the degree of swelling by water was high (from 150 to 300%) as described above was severe and thus, the fibers had the problem that the application to the uses requiring the form stability was difficult.

On the other hand, it was known, for example, by Japanese Patent Laid-Open No. 91271/1990 that the treatment time for imparting the moisture absorbing-moisture releasing property could be shortened by simultaneously carrying out crosslinking and the hydrolytic reaction.

However, in the method of prior art of simultaneously carrying out crosslinking and the hydrolytic reaction, reaction rate of crosslinking is slow, whereby the crosslinking reaction becomes a rate-determining step. For example, to obtain the crosslinking degree of the increase in nitrogen content=0.6%, 5 hours (98° C.) was required for the crosslinking reaction at a hydrazine concentration of 2% (bath ratio 1:10).

As described above, when the hydrazine concentration used for the crosslinking treatment was allow concentration (for example, about 2%), a long time was required for making the crosslinking degree a desired range to advance the hydrolysis more than necessary. As the result thereof, the reaction of an alkali metal hydroxide was severe, whereby there were problems that the degree of swelling by water of the moisture absorbing fibers obtained was increased and the strength was also lowered.

For avoiding the occurrences of such problems, there is a method of increasing the degree of crosslinking by increasing the hydrazine concentration (for example 5% or higher) or increasing the treatment temperature (for example, 98° C. or higher) to shorten the crosslinking treatment time (about 2 hours). However, in the method, there was a problem that the amounts of the chemical liquids (hydrazine and sodium carbonate, etc.) for the crosslinking treatment and the hydrolytic treatment or the energy required for increasing the treatment temperature was increased.

Thus, an object of the present invention to provide a production method capable of reducing the amounts of the chemical liquids (hydrazine and sodium carbonate, etc.) for the crosslinking treatment and the hydrolytic treatment, capable of shortening the treatment time, and capable of obtaining crosslinked acrylic moisture absorbing fibers having a sufficient moisture absorbing-moisture releasing performance by using specific raw material fibers, and to provide the crosslinked acrylic moisture absorbing fibers at a low cost.

Furthermore, another object of the invention is to provide, in addition to the above-described object, crosslinked acrylic moisture absorbing fibers capable of repeatedly and reversibly carrying out a moisture absorption and moisture releasing, and also to provide crosslinked acrylic moisture absorbing fibers which has excellent form-stability after absorbing moisture and the production method.

DISCLOSURE OF THE INVENTION

The present invention is crosslinked acrylic moisture absorbing fibers obtained by applying a crosslinking treatment with a hydrazine compound and a hydrolytic treatment with sodium carbonate to acrylic fibers made of an acrylic copolymer containing from 1% by weight to 5% by weight a comonomer having an acidic group and is the production method the crosslinked acrylic moisture absorbing fibers.

The production method of crosslinked acrylic moisture absorbing fibers of the invention has the feature that in the crosslinking treatment with a hydrazine compound and the hydrolytic treatment with sodium carbonate, the reduction of the amounts of these chemical liquids and shortening of the treatment time become possible and the crosslinked acrylic moisture absorbing fibers having a low degree of swelling by water is obtained.

Also, the production method of crosslinked acrylic moisture absorbing fibers of the invention has the feature that because the acrylic fibers to be treated contain from 1 to 5% by weight a comonomer having an acidic group as a comonomer component, the crosslinking reaction and the hydrolytic reaction are accelerated.

The present inventors investigated the relation of a hydrazine concentration and a nitrogen content (extent of crosslinking) or the relation of the treatment time and the nitrogen content (extent of crosslinking) per each concentration of the acidic group-containing comonomer. As the result thereof, it has been found that when acrylic fibers made of a copolymer containing at least 1% by weight an acidic group-containing comonomer are used, by carrying out the crosslinking treatment for a time of from 0.5 to 2 hours at a temperature of about 98° C. using an aqueous solution (bath ratio 1:10) of at least 0.5% by weight and lower than 5.0% by weight the hydrazine concentration, the object of the invention can be sufficiently attained.

In this invention, the hydrazine concentration means the concentration of the hydrazine component in the above-described hydrazine compound.

When the above-described content acidic group-containing comonomer exceeds 5% by weight, as the characteristics of the acidic group-containing comonomer, lowering of the coagulation property at wet spinning and adhered yarns accompanied thereby occur, and also the heat resistance of the copolymer is extremely lowered, which are undesirable.

When the copolymer contains other comonomer component in addition to the acidic group-containing comonomer, it is preferred that the contents of the comonomers are adjusted such that the sum total of the amounts of the comonomers become not more then 20% by weight and the copolymer contains at least 80% by weight the acrylonitrile component. When the content of the acrylonitrile component becomes less than 80% by weight, the content of the nitrile group of the copolymer is reduced, whereby the crosslinking reaction and the hydrolytic reaction are undesirably delayed.

In the invention, by introducing a crosslinked structure to the acrylic fibers made of the acrylonitrile-base copolymer containing from 1 to 5% by weight comonomer having an acidic group using a hydrazine compound such that the increase of the nitrogen content becomes from 0.4 to 2.0%, and also by controlling the acrylic fibers by a hydrolytic reaction. with sodium carbonate such that the content of the carboxyl group becomes from 0.6 to 4.0 mmol/g, the crosslinked acrylic moisture absorbing fibers having the performance of the saturated moisture absorbing rate at 20° C. and 65% RH of at least 15% and not higher than 50% and a degree of swelling by water of at least 10% and not higher than 100% can be produced.

The comonomer having an acidic group used in the invention is a vinyl monomer having the acidic group usually used, which can be copolymerized with acrylonitrile, and the practical examples thereof include a compound having a carboxyl group, such as acrylic acid, methacrylic acid, itaconic acid, etc., or the salts thereof and a compound having a sulfonic acid group, such as allylsulfonic acid, methallylsulfonic acid, etc., or the salts thereof.

The acrylic fibers having a dry strength of from 3 to 10 g/d can be used as the raw material to be treated but in the case of obtaining the moisture absorbing fibers having a dry strength of at least 2 g/d, the dry strength of the raw material to be treated is preferably from 5 to 10 g/d. Also, the thickness of the fibers as the raw material to be treated is preferably from about 1 to 15 deniers (s), which is used for acrylic fibers widely used, because in this case, the fiber properties and the workability of the moisture absorbing fibers are well-balanced.

In the crosslinking treatment of acrylic fibers in the invention, it is desirable to use a hydrazine compound. As the crosslinking condition by the treatment, a condition that the increase of nitrogen content in the fibers becomes from 0.4 to 2.0% can be employed.

The hydrazine compound which can be used in the crosslinking treatment includes hydrazine hydrochloride, hydrazine sulfate, hydrazine hydrate, hydrazine carbonate, etc., and there is no particular restriction on the hydrazine compound.

The hydrolytic treatment is carried out using sodium carbonate in the invention and in this case, it is preferred that in the hydrolytic treatment, the amount of the carboxyl group is controlled to from 0.6 to 4.0 mmol/g.

The reaction rate of the hydrolysis with sodium carbonate is scarcely influenced by the kind of comonomer used but as the result of various investigations, the present inventors have found that when the degree of crosslinking is increased, the rate of the hydrolysis is accelerated. That is, when crosslinking is sufficiently carried out, the result thereof is effective for the reduction of the using amount of sodium carbonate in the hydrolytic treatment and shortening of the treatment time.

It is known to use an alkali metal hydroxide for a hydrolytic treatment but when an alkali metal hydroxide is used, the reaction becomes severe and it becomes difficult to lower the degree of swelling by water of the fibers below 100%. On the other hand, the use of sodium carbonate is preferred because the hydrolytic reaction becomes slow and the degree of swelling by water of the fibers can be lowered below 100%.

The crosslinking treatment and the hydrolytic treatment of the acrylic fibers can be simultaneously carried out or after the crosslinking treatment, the hydrolytic treatment may be carried out.

Because when the amount of the acidic comonomer in the acrylic fibers of the raw material to be treated is at least 1% by weight and not more than 5% by weight as in the invention, the crosslinking reaction of the acrylic fibers in the invention is accelerated as compared with acrylic fibers without containing an acidic comonomer, to obtain the crosslinked acrylic moisture absorbing fibers having the degree of crosslinking almost same as that of prior art, the using amount of hydrazine and the treatment time can be reduced in the present invention.

According to the method of the invention, because the crosslinking reaction is accelerated as described above, the treatment time required for crosslinking is greatly shortened, and, for example, in the treatment at the hydrazine concentration of 2% (bath ratio 1:10). the sodium carbonate concentration of 10%, and at 98° C., the moisture absorbing fibers are obtained within one hour.

BEST MODE FOR CARRYING OUT THE INVENTION

Figure 1:
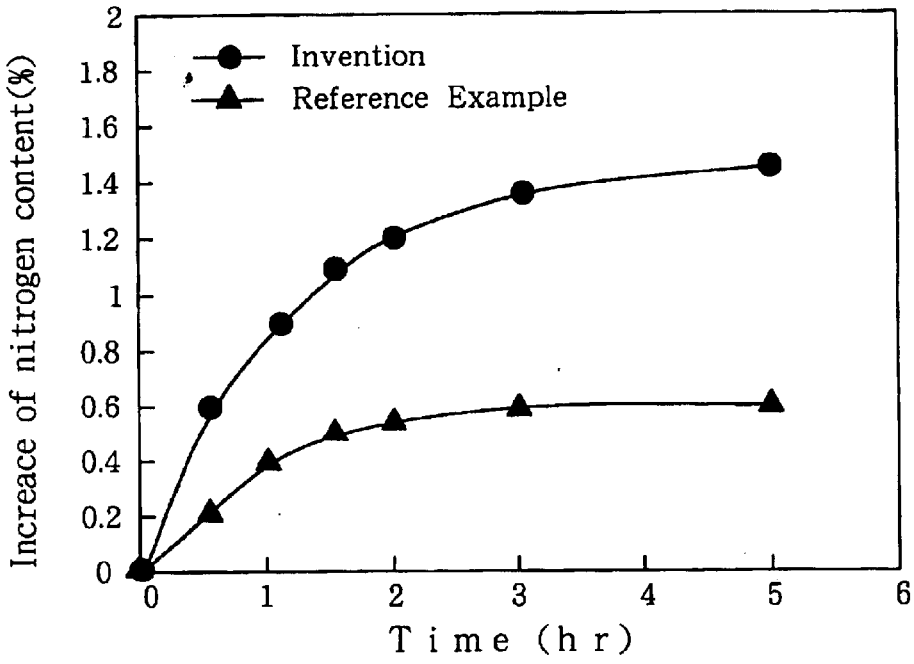
FIG. 1 is a graph showing the relation of the treatment time and the increase in nitrogen content in the case of a constant hydrazine concentration.

Then, the present invention is practically explained by the following examples, wherein "%", unless otherwise indicated, is "% by weight". Also, the increase in nitrogen content, the amount of the carboxyl group, the moisture absorbing rate, and the degree of swelling by water were obtained by the following methods.

(1) Increase in Nitrogen Content(%):

By an elemental analysis, the nitrogen content (%) of fibers after the hydrazine crosslinking treatment and the nitrogen content (%) of the raw material fibers were obtained and the difference of these contents was defined as the increase in nitrogen content.

(2) The amount of carboxyl group (mmol/g):

About 1 g of a sufficiently dried sample was accurately weighed (X g) and after adding thereto 200 ml of water, 1 N aqueous hydrochloric acid solution was added to adjust the pH thereof to 2. Then, using 1 N aqueous sodium hydroxide solution, according to an ordinary method, a titration curve was obtained. From the titration curve, the consumed amount (Y ml) of the aqueous sodium hydroxide solution consumed for the carboxyl group was determined and the amount of carboxyl group was obtained by the following equation.

$$\text{The amount of carboxyl group (mmol/g)}=Y/X$$

(3) The Moisture Absorption Rate (%):

Sample fibers were dried at 105° C. for 2 hours and the weight ($W_1$) thereof was measured. Then, the sample fibers were placed in a constant temperature bath of 20° C. and 65% RH until the amount of the sample became constant, the weight ($W_2$) thereof was measured, and the moisture absorbing rate was obtained by the following equation.

$$\text{The moisture absorption rate (\%)}=[(W_2-W_1)/W_1]\times 100$$

(4) The Degree of Swelling by Water (%):

After immersing sample fibers in pure water at 25° C. for 24 hours, using a centrifugal dehydrator (H-100F2: trade name, manufactured by Kokusan Enshinki K.K.), attached water was removed at 3000 rpm×5 minutes, and the weight ($W_3$) of the sample fibers was measured. Then, the sample fibers were dried by a hot blast dryer of 105° C. until the amount thereof became constant, the weight ($W_4$) thereof was measured, and the degree of swelling by water was obtained by the following equation.

$$\text{The degree of swelling by water(\%)}=[(W_3-W_4)/W_4]\times 100$$

EXAMPLE 1

Various acrylic raw materials made of acrylonitrile and each of various kinds of neutral comonomers or each of various kinds of acidic comonomers at various ratios shown in Table 1 below were prepared, and each raw material was solution-polymerized in an aqueous solution of zinc chloride to prepare each spinning solution. Using each of the spinning solutions, wet spinning was carried out according to an ordinary method and each of various acrylic fibers as raw material fibers to be treated of a single fiber denier of 1.5 d was obtained.

Then, 100 g of each raw material fibers to be treated were subjected to a crosslinking treatment of 98° C.×1 hour in an aqueous solution (bath ratio 1:10) of 2% hydrazine hydrate (as $NH_2NH_2$). The nitrogen content of each acrylic fibers after crosslinking was measured by an elemental analysis and the value obtained was shown in Table 1.

Thereafter, each acrylic fibers after crosslinking were subjected to a hydrolytic treatment of 98° C.×1 hour in an aqueous solution (bath ratio 1:10) of 10% sodium carbonate, the carboxyl group amount of each fibers thus treated was measured, and the value was shown in Table 1.

Furthermore, about each acrylic fibers after the hydrolysis, after water-washing and drying, the saturated moisture absorbing rate at 20° C. and 65% RH and the degree of swelling by water were measured, and these values were shown in Table 1.

In Table 1, Experiment No. 1 shows the homopolymer of acrylonitrile (AN), Experiment Nos. 2 to 5 show the copolymer of AN and methyl acrylate (MA). Experiment Nos. 6 to 9 show the copolymer of AN and vinyl acetate (VAc), Experiment Nos. 10 to 13 show the copolymer of AN and acrylamide (AAm). Experiment Nos. 14 to 17 show the copolymer of AN and itaconic acid (IA), Experiment Nos. 18 to 21 show the copolymer of AN and acrylic acid (AA), Experiment Nos. 22 to 25 show AN and methacrylic acid (MAA), and Experiment Nos. 26 to 29 show the copolymer of AN and methacrylsulfonic acid (MAS).

TABLE 1

| Experiment NO. | Copolymer Composition (%) | Spinning Property | Cross-linked Increase of Nitrogen Content (%) | Hydrolysis-COOX (mmol/g) | Moisture Absorption (%) | Degree of Swelling by Water (%) |
|---|---|---|---|---|---|---|
| 1(Ref. Ex.) | AN = 100 | ○ | 0.4 | 0.4 | 7 | 43 |
| 2(Ref. Ex.) | AN/MA = 99/1 | ○ | 0.4 | 0.4 | 7 | 45 |
| 3(Ref. Ex.) | AN/MA = 97/3 | ○ | 0.3 | 0.5 | 9 | 52 |
| 4(Ref. Ex.) | AN/MA = 95/5 | ○ | 0.3 | 0.5 | 9 | 48 |
| 5(Ref. Ex.) | AN/MA = 90/10 | ○ | 0.4 | 0.5 | 9 | 60 |
| 6(Ref. Ex.) | AN/VAc = 99/1 | ○ | 0.3 | 0.4 | 9 | 40 |
| 7(Ref. Ex.) | AN/VAc = 97/3 | ○ | 0.3 | 0.5 | 10 | 62 |
| 8(Ref. Ex.) | AN/VAc = 95/5 | ○ | 0.3 | 0.5 | 10 | 78 |
| 9(Ref. Ex) | AN/VAc = 90/10 | ○ | 0.3 | 0.6 | 13 | 79 |
| 10(Ref. Ex.) | AN/AAm = 99/1 | ○ | 0.2 | 0.4 | 9 | 108 |
| 11(Ref. Ex.) | AN/AAm = 97/3 | ○ | 0.2 | 0.5 | 11 | 114 |
| 12(Ref. Ex.) | AN/AAm = 95/5 | ○ | 0.2 | 0.6 | 13 | 160 |
| 13(Ref. Ex.) | AN/AAm = 93/7 | ○ | — | — | — | — |
| 14(Inv.) | AN/IA = 99/1 | ○ | 0.7 | 0.9 | 20 | 38 |
| 15(Inv.) | AN/IA = 97/3 | ○ | 1.1 | 1.5 | 29 | 57 |
| 16(Inv.) | AN/IA = 95/5 | Δ | 1.2 | 2.2 | 32 | 67 |
| 17(Ref. Ex.) | AN/IA = 93/7 | X | — | — | — | — |
| 18(Inv.) | AN/AA = 99/1 | ○ | 0.6 | 0.7 | 18 | 77 |
| 19(Inv.) | AN/AA = 97/3 | ○ | 0.9 | 1.1 | 22 | 88 |
| 20(Inv.) | AN/AA = 95/5 | ○ | 1.1 | 1.5 | 28 | 89 |
| 21(Ref. Ex.) | AN/AA = 93/7 | X | — | — | — | — |
| 22(Inv.) | AN/MAA = 99/1 | ○ | 0.7 | 0.9 | 21 | 76 |
| 23(Inv.) | AN/MAA = 97/3 | ○ | 0.9 | 1.3 | 25 | 84 |
| 24(Inv.) | AN/MAA = 95/5 | Δ | 1.3 | 2.0 | 30 | 98 |
| 25(Ref. Ex.) | AN/MAA = 93/7 | X | — | — | — | — |
| 26(Inv.) | AN/MAS = 99/1 | ○ | 0.7 | 0.9 | 21 | 63 |
| 27(Inv.) | AN/MAS = 97/3 | ○ | 1.1 | 1.6 | 26 | 89 |
| 28(Inv.) | AN/MAS = 95/5 | Δ | 1.3 | 2.2 | 34 | 96 |
| 29(Ref. Ex.) | AN/MAS = 93/7 | X | — | — | — | — |

(Note) Spinning property: Good 0 > Δ > x Bad
Ref Ex.: Reference Example
Inv.: Example of the invention.

According to the results shown in Table 1 above, it can be seen that in the copolymer of acrylonitrile and the acidic copolymer of the invention, the reactions of both the crosslinking reaction (increase in nitrogen content) and the hydrolysis (amount of carboxyl group) are more advanced as compared with the AN homopolymer and the copolymers of AN and each of the neutral copolymers.

Also, it can be seen that about Experiment Nos. 13, 17, 21, 25, and 29, the spinning property, that is, the coagulation property is inferior and fibers cannot be formed.

EXAMPLE 2

Acrylic fibers of 1.5 d made of the copolymer composition of AN/MA/MAS=90/8/2 were obtained by ordinary spinning. The spinning property was good.

The acrylic fibers were cut to 51 mm and were subjected to a crosslinking treatment at 98° C. by changing the treatment time with a constant hydrazine concentration ($NH_2NH_2$=2%). On the other hand, at a definite treatment time (one hour), the crosslinking treatment was carried out at 98° C. by changing the hydrazine concentration.

As the reference example, the fibers of Experiment No. 5 of Table 1 described above were used.

About the case of a constant hydrazine concentration, the relation of the treatment time and the increase in nitrogen content is shown in FIG. 1 as a graph. Also, in the case of changing the hydrazine concentration, the relation of the hydrazine concentration and the increase in nitrogen content by the crosslinking reaction is shown in FIG. 2 as a graph.

According to the graph of FIG. 1, it can be seen that the time of obtaining a definite crosslinking degree (increase in nitrogen content) may be shorter than a half in the invention as compared with the reference example.

Figure 2:
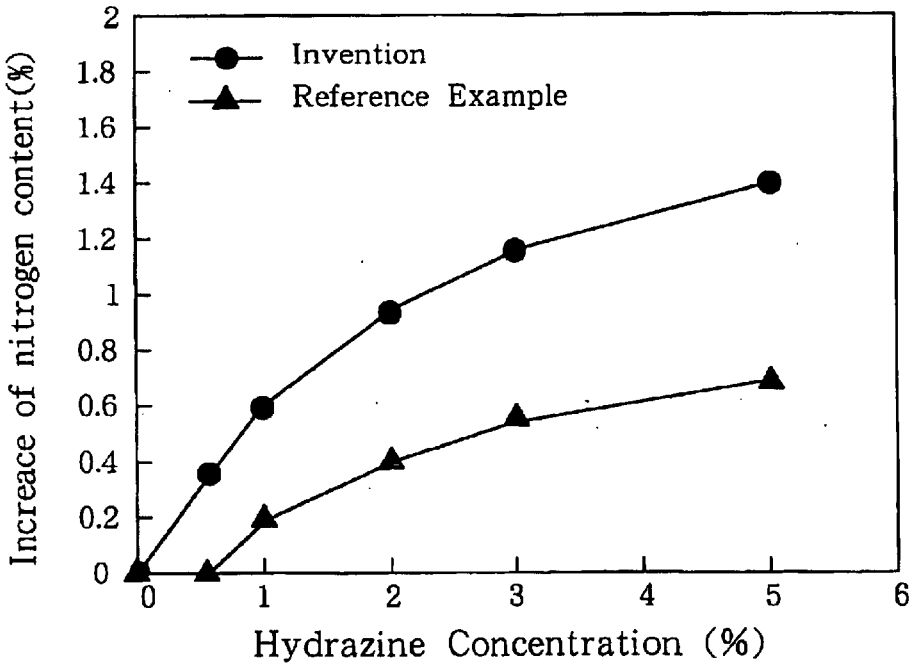
FIG. 2 is a graph showing the relation of the hydrazine concentration and the increase in nitrogen content by the crosslinking reaction in the case of changing the hydrazine concentration.

Also, according to the graph of FIG. 2, it can be seen that the treatment concentration for obtaining a definite degree of crosslinking (increase in nitrogen content) may be the concentration of lower than a half in the case of the invention as compared with the reference example.

EXAMPLE 3

Acrylic fibers of 1.5 d made of the copolymer composition of AN/MA/IA=94/4.5/1.5 were obtained by ordinary spinning. The spinning property was good.

The acrylic fibers having a dry strength of 8 g/d and a dry ductility of 10% were treated at 98° C. for one hour in a mixed solution (bath ratio 1:10) of 2% a hydrazine concentration and 10% sodium carbonate to obtain crosslinked acrylic moisture absorbing fibers.

The characteristics of the crosslinked acrylic moisture absorbing fibers obtained are shown in Table 2 below.

TABLE 2

| Denir | Dry Strength | Dry Elongation | Moisture Absorption Rate | Degree of Swelling by Water |
|---|---|---|---|---|
| 2.8 d | 2.0 g/d | 27% | 25% | 56% |

As shown in Table 2, the characteristics of the crosslinked acrylic moisture absorbing fibers of the invention were very good.

INDUSTRIAL APPLICABILITY

In the crosslinked acrylic moisture absorbing fibers obtained by applying the crosslinking treatment and hydrolytic treatment according to the production method of the invention, the hydrazine concentration of the treatment solution used can be reduced or the treatment time can be greatly shortened as compared with fibers of prior art without containing the acidic group or containing less than 1% by weight the acidic group. Furthermore, it is also preferred in the invention that the residual hydrazine concentration in the treatment solution after the crosslinking treatment is very low and a neutralization treatment for a waste solution is unnecessary or if necessary, the waste solution may be treated with a very small amount of a neutralizing agent.

What is claimed is:

1. A method of producing crosslinked acrylic moisture absorbing fibers, which comprises applying a crosslinking treatment with a hydrazine compound and a hydrolytic treatment with sodium carbonate to acrylic fibers made of an acrylonitrile-base copolymer containing at least 1% by weight and not more than 5% by weight a comonomer having an acidic group or salt thereof as a comonomer component.

2. A method of producing crosslinked acrylic moisture absorbing fibers, which comprises introducing a crosslinked structure into acrylic fibers made of an acrylonitrile-base copolymer containing at least 1% by weight and not more than 5% by weight a comonomer having an acidic group as a comonomer component using a hydrazine compound such that the increase in the nitrogen content becomes from 0.4 to 2.0% and carrying out a hydrolytic reaction with sodium carbonate by controlling such that the amount of the carboxylic group becomes from 0.6 to 4.0 mmol/g.

3. The method of producing crosslinked acrylic moisture absorbing fibers according to claim 1 or 2 wherein the comonomer having the acidic group or salt thereof is at least one compound selected from the group consisting of a compound having a carboxyl group and the salts thereof and a compound having a sulfonic acid group and the salts thereof.

* * * * *